United States Patent [19]

Nakajima et al.

[11] 4,453,688

[45] Jun. 12, 1984

[54] BLIND MOUNTING DEVICE

[75] Inventors: Akira Nakajima; Takayoshi Furukawa, both of Kanagawa; Atsuo Nakano, Tokyo; Kunio Yamashiro, Sagamihara; Katsumi Goda, Naka, all of Japan

[73] Assignee: Kabushiki Kaisha Nichibei, Tokyo, Japan

[21] Appl. No.: 338,986

[22] Filed: Jan. 12, 1982

[30] Foreign Application Priority Data

Jun. 23, 1981 [JP] Japan ..... 56-92702[U]

[51] Int. Cl.[3] ..... A47H 1/10

[52] U.S. Cl. ..... 248/262; 248/254

[58] Field of Search ..... 248/262, 261, 544, 265, 248/264, 267, 269, 263, 268, 270, 273; 160/178 B, 38, 39

[56] References Cited

U.S. PATENT DOCUMENTS 1,363,321 12/1920 Jaeger ..... 248/273 X 4,352,478 10/1982 Loew ..... 248/221.3

FOREIGN PATENT DOCUMENTS 4770 5/1932 Australia ..... 248/262

1409816 10/1975 United Kingdom ..... 248/273

*Primary Examiner*—J. Franklin Foss

*Attorney, Agent, or Firm*—Toren, McGeady and Stanger

[57] ABSTRACT

A device for mounting a blind of a window frame or the like, which includes a base plate on which the blind is fixed by means of brackets and at least two supporting members which are fixed on the window frame, wall surface or the like in spaced relation with each other, in which the base plate can be fixedly hooked on the support members.

1 Claim, 6 Drawing Figures

BLIND MOUNTING DEVICE

BACKGROUND OF THE INVENTION

1. Field of the Invention

The present invention relates to a device for mounting a blind on a window frame, wall surface or the like, and particularly it relates to a device of such kind which can be effectively used to mount a roll-blind.

2. Description of Prior Art

Heretofore, in order to mount a roll-blind on the window frame or the like, it has been necessary to decide the position of mounting the blind, put marks on the positions where brackets are to be fixed, then fix the bracket in such positions by means of screws or the like and mount the blind on said brackets. Particularly, in case of a roll-blind which is supported at its both ends by means of brackets, the brackets should be located at precise positions, otherwise the blind could not be properly mounted on the window frame or the like. Therefore the mounting of the roll-blind requires complicated and troublesome operation.

It is a principal object of the present invention to avoid such complicated and troublesome operation required to mount a blind.

SUMMARY OF THE INVENTION

It is an object of the present invention to provide a device for mounting a blind, particularly a roll-blind, in which the mounting and demounting of the blind can be easily effected and the mounting position can be finely adjusted even after the blind has been mounted.

In accordance with the present invention there is provided a device for mounting a blind on a wall surface which comprises a base plate on which a blind is mounted by means of two brackets which are fixed on said base plate at a predetermined distance from each other, and at least two supporting members, each including a hook member having hooks at its upper and lower edges and a supporting plate connected with said hook member, which are fixed on said wall surface at any suitable distance from each other, said base plate having the blind previously mounted thereon being mounted onto said supporting members by fixedly engaging the upper and lower edges of said base plate with the hooks of said hook members of said blind supporting members, whereby the blind is mounted on said wall surface.

DETAILED DESCRIPTION OF THE INVENTION

Now the invention will be explained with reference to the accompanying drawings which illustrate an embodiment of the invention.

DESCRIPTION OF PREFERRED EMBODIMENTS

Figure 1:
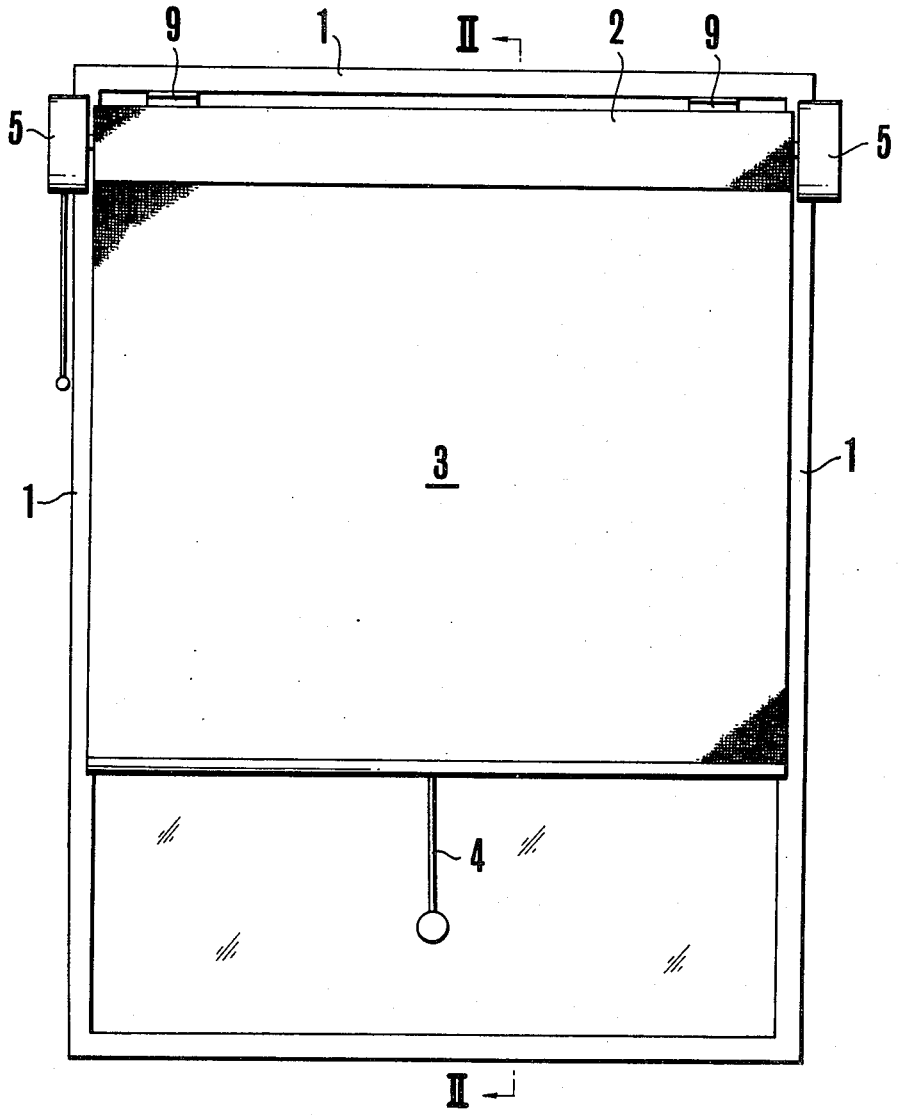
FIG. 1 is an elevational view showing the blind which is mounted by means of the device according to the present invention.
Figure 2:
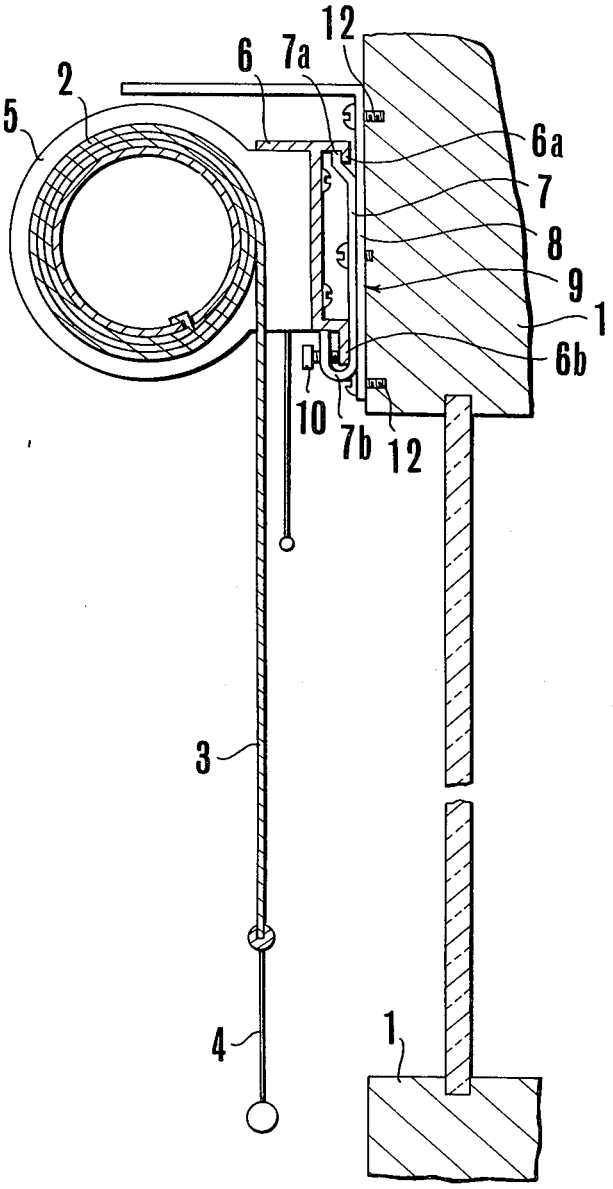
FIG. 2 is a sectional view taken along the line II—II in FIG. 1.

Referring to the drawings, 1 designates a window frame, 2 designates a roll-blind, 3 designates a blind cloth, 4 designates an operating cord, and 5 designates a bracket for supporting the roll-blind.

The device for mounting the blind according to the present invention comprises a base plate 6 on which the blind 2 is mounted by means of two brackets 5 which are fixed on said base plate 6 at a predetermined distance from each other, and two supporting members 9, each including a hook member 7 having hooks 7*a* and 7*b* at its upper and lower edges and a supporting plate 8 connected with said hook member, which are fixed on the window frame, wall surface or other surface on which the blind is to be mounted, at a suitable distance from each other. Said base plate 6 having the blind 2 previously mounted thereon is connected onto said supporting members 9 by bringing the upper and lower edges of said base plate 6 into engagement with the hooks 7*a* and 7*b* of said hook members 7 of said supporting members 9 and then fixedly connecting said base plate 6 with said hook members 7 by means of fastening elements such as screws 10, whereby the blind 2 is mounted on the window frame, wall surface or the like.

In the embodiment as shown in the drawings, the base plate 6 is formed at its upper and lower edges with hook portions 6*a* and 6*b*, respectively, which are brought into engagement with the hooks 7*a* and 7*b* of the hook member 7, and the screw 10 is threaded into the lower hook 7*b* of the hook member 7 to fix the lower hook portion 6*b* of the base plate 6 in said lower hook 7*b*, thereby fixing the base plate 6 by the supporting member 9.

Further, in the embodiment as shown in the drawings, the supporting member 9 (FIG. 5) consists of an L-shaped supporting plate 8 and a hook member 7 which is rotatably mounted on the center of one leg 8*a* of said L-shaped plate by means of a pivot 11.

Figure 3:
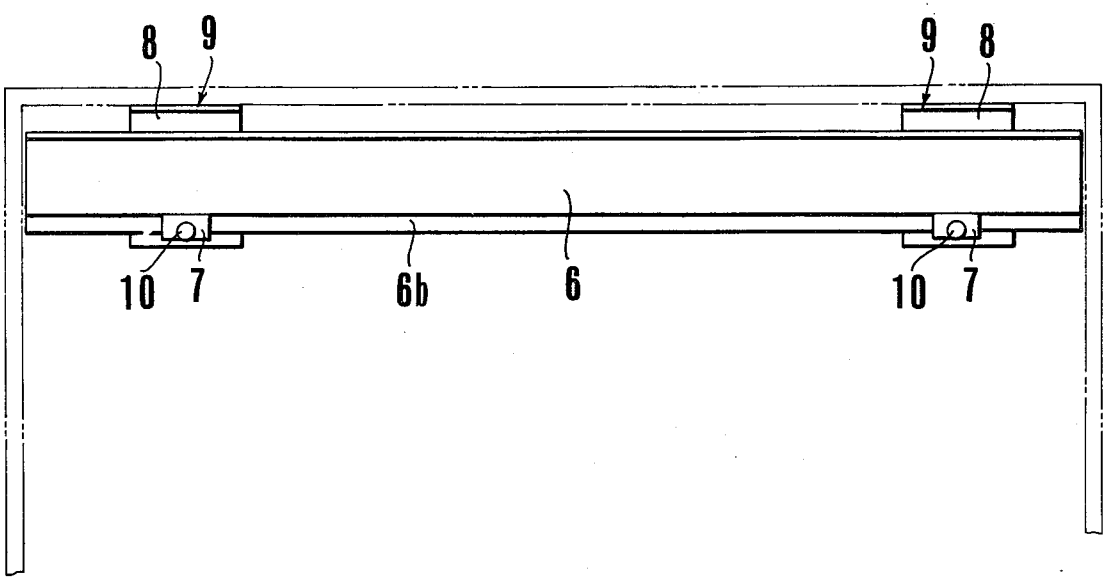
FIG. 3 is an elevational view showing the base plate supported on the supporting members.

FIG. 3 shows the device according to the present invention in a state where the base plate 6 is mounted on the supporting members 9. In this state the base plate 6 is engaged in the hook members 7 on the supporting plates 8 and locked thereto by the screws 10 which are threaded into the lower hooks 7*b* of the hook members 7 and pressed against the hook portions 6*b* of the base plate 6.

When a roll-blind is mounted on a wall surface by the device according to the present invention, firstly a plurality of the supporting members 9, each having the supporting plate 8 and the hook member 7, are attached at a suitable distance on the wall surface at their legs 8*a* of said supporting plates 8 by means of screws 12 or the like and then the base plate 6 on which the roll-blind has been previously mounted on said supporting members 9 by bringing the upper and lower hook portions 6*a* and 6*b* of said base plate 6 into engagement with the hooks 7*a* and 7*b* of said hook members 7. The position of the blind is adjusted by sliding said base plate 6 to the right or left in said supporting members 9, and at a desired position of said blind the screws 10 are tightened to fix the blind at the desired position.

Figure 4:
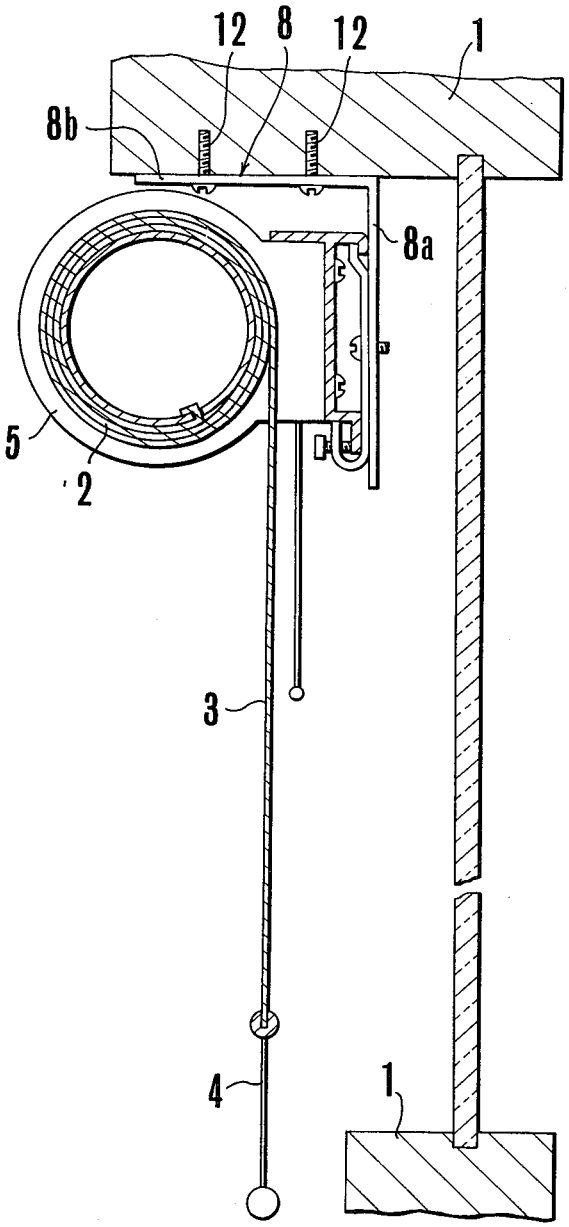
FIG. 4 is a sectional view similar to FIG. 2, showing the different mode of using the supporting members.

FIG. 4 shows the roll-blind mounted on the ceiling surface by the device according to the present invention. In this case, the supporting members 9 are fixed at the legs 8*b* of the supporting plates 8 on the ceiling surface by means of screws 12 or the like, and the blind is supported by these supporting members.

Figure 5A:
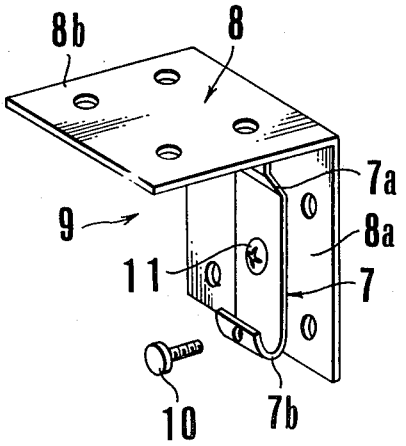
FIG. 5 (*a*) and (*b*) are perspective views showing the supporting member.
Figure 5B:
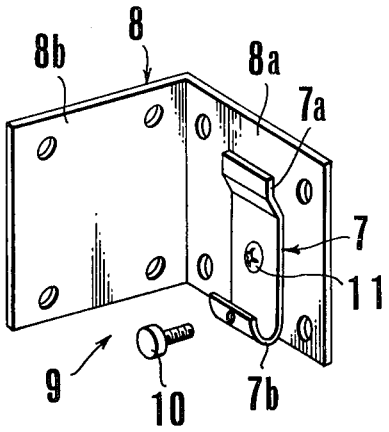

FIGS. 5(*a*) and (*b*) are perspective views showing the supporting member. FIG. 5(*a*) shows the state in which it is used to support the blind in front of a wall surface or ceiling surface, while FIG. 5(*b*) shows the state in which it is used to support the blind at its end surface. The state of the supporting member as shown in FIGS. 5(*a*) and (*b*) can be changed by rotating the hook member 7 around the pivot 11 by 90 degrees, as desired.

It will be understood from the above explanation that in accordance with the present invention a roll-blind is previously mounted on a base plate and then said base plate is mounted on a window frame or the like. Consequently, the mounting of the roll-blind on the window frame or the like does not require the troublesome step of measuring the length of the roll-blind and deciding the precise positions of the brackets for supporting the blind which are to be fixed on the window frame or the like. That is, the roll-blind can be easily mounted, without such troublesome step, by fixing two supporting members at suitable positions on the window frame or the like and then mounting the base plate, on which the roll-blind has been previously mounted, upon said supporting members, whereby the roll-blind is mounted on the window frame through the intermediary of the base plate. Furthermore, the precise position of the blind on the window frame or the like can be finely adjusted, after mounting, by sliding the base plate along the supporting members to right and left. Thus the device for mounting the blind according to the present invention allows easy mounting of the blind as well as the easy adjustment of the position of the blind.

What is claimed is:

1. A device for mounting a blind on a wall surface comprising an elongated base plate having a pair of spaced edges extending in the elongated direction thereof, a pair of brackets mounted on said base plate and spaced apart thereon in the elongated direction of said base plate at a predetermined distance corresponding to the length of the blind, and at least a pair of angle shaped supporting members each fixable to a wall surface in spaced apart relation at a distance less than the elongated dimension of said base plate, each said supporting member having a first leg and a second leg disposed substantially perpendicularly to said first leg, each of said first and second legs being selectably fixable to the wall surface, a hook member pivotally mounted on one of said legs and fixable to said leg in a given position, said hook member having opposite ends thereon shaped to form hooks disposed in spaced relation extending transversely of the elongated direction of said base plate, said hook members being disposed in spaced relation to said leg on which said hook member is pivotally mounted, and said elongated edges of said base plate being shaped to interfit with said hooks so that said base plate can be slid in the elongated direction thereof while in engagement with said hooks, and means for fixing said base plate relative to said hook members.

* * * * *